United States Patent [19]

Dietrich et al.

[11] 4,121,382

[45] Oct. 24, 1978

[54] MECHANIZED DOOR OPERATING MEANS FOR A MOTOR VEHICLE

[76] Inventors: Edward J. Dietrich, 5126 Bond Ave., Drexel Hill, Pa. 19026; Henry Hoiler, 4635 N. 5th St., Philadelphia, Pa. 19140

[21] Appl. No.: 815,513

[22] Filed: Jul. 14, 1977

[51] Int. Cl.[2] ..... E05F 15/18

[52] U.S. Cl. ..... 49/334; 49/280; 49/337

[58] Field of Search ..... 49/334, 335, 337, 280, 49/139, 30

[56] References Cited

U.S. PATENT DOCUMENTS

| | | | |
|---|---|---|---|
| 2,591,693 | 4/1952 | Gatesy | 49/139 X |
| 3,141,662 | 7/1964 | Wise | 49/280 |

*Primary Examiner*—Kenneth Downey

*Attorney, Agent, or Firm*—Woodcock, Washburn, Kurtz & Machiewicz

[57] ABSTRACT

An electrically powered drive system for automatically opening and/or closing the door of a motor vehicle. An electric drive assembly including a motor and an irreversible gear box is coupled to the hinge of the door by means of a normally-disengaged clutch. Control means are provided for selectively energizing the motor and clutch. In a preferred embodiment a solenoid is coupled to the system for unlatching the door preparatory to energization of the drive motor.

8 Claims, 3 Drawing Figures

MECHANIZED DOOR OPERATING MEANS FOR A MOTOR VEHICLE

BACKGROUND OF THE INVENTION

The present invention relates to motor vehicles, and more particularly to a drive system for automatically operating a door thereof.

Over the three-quarters of a century during which the automobile has been present, it has undergone a constant evolutionary process. Automobiles have been the subject of experimentation and invention by mechanics, engineers and scientists and no aspect of the system has escaped attention. Despite this fact, and despite the implementation of spring-loaded hinges, counterbalances and the like the operation of the doors on a modern-day motor vehicle continues to be difficult. As automobiles have grown larger and heavier, the size of their doors has increased to match. The manipulation of doors on larger automobiles has become a difficult task for children, and for aged or infirm individuals. While in many instances it is not overly difficult to open or close an automobile door while the vehicle is on a level plane should the vehicle be laterally inclined, as when parked on a hill or a steeply-crowned street, manipulation of the doors becomes excessively burdensome. This is due to the fact that when on a level plane one has only to overcome the inertia of the door; while on an incline one must actually raise the door against the force of gravity. Such a situation presents hazards, inasmuch as if the door is suddenly released it will forcibly shut, possibly injuring an individual's fingers or hand; and further, it presents a genuine problem for aged or infirm persons who are hard put to manage the heavy weight involved.

Attempts have been made to devise systems which would automatically open and/or close vehicle doors. Some examples of attempts are shown in U.S. Pat. Nos. 2,321,286—Etsel, 3,002,581—Deibel et al., and 2,628,091—Rappl. Electrically or electromechanically-operated systems have also been tried; examples of such systems may be found in U.S. Pat. Nos. 1,151,479—Kurtz and 3,069,151—Cook et al.

While a great deal of effort has obviously been expended in order to provide an automatic door opening system which is feasible for an automobile, to date it is well known that none of these effects have succeeded. Aside from a few specially-built automobiles having doors hinged in the roof structure and which swing upwardly, no automobiles are available which have automatic door opening systems. Thus, although the need is apparent and many have attempted to fulfill it, to date no system has been provided which is sufficiently safe, foolproof and economical to warrant its implementation in a mass-produced automobile. One reason for this is the fact that with most prior art systems a failure of the system would either cause the door to become stuck in an open position or conversely to remain closed, thus trapping the occupants of the vehicle until repairs could be accomplished. Still another problem is the elaborate nature of the prior art systems, which was detrimental to the reliability of such systems and made them quite difficult to install and maintain. Accordingly, it will be appreciated that it would be highly desirable to provide an improved door opening and/or closing system which obviates the foregoing disadvantages and is susceptible for installation in a mass-produced motor vehicle.

It is therefore an object of the present invention to provide an improved door opening mechanism.

Another object is to provide an automatic door mechanism which exhibits fail-safe operation.

Yet another object is to provide a physically compact door opening system susceptible of installation in present-day automobiles.

A further object of the present invention is to provide a door operating mechanism for a motor vehicle which is structurally simple and rugged.

SUMMARY OF THE INVENTION

Briefly stated, in accordance with one aspect of the invention the foregoing objects are achieved by providing an electric motor and a reduction gear unit coupled to the motor for multiplying its torque output. A normally-disengaged electromagnetic clutch is connected between the reduction gear unit and the hinge of the door mechanism, such that the clutch unit exerts a twisting force upon the hinge itself. An electric control system for supplying current to the motor to drive it in a forward and/or reverse mode is provided, and is further coupled to the electromagnetic clutch so that the clutch is engaged only when the motor is to be operated.

In a preferred embodiment an electric solenoid is coupled to the door latch assembly and actuated by means of the same control system. A time delay unit is provided to prevent the motor from operating until the latch can be disengaged by the solenoid.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
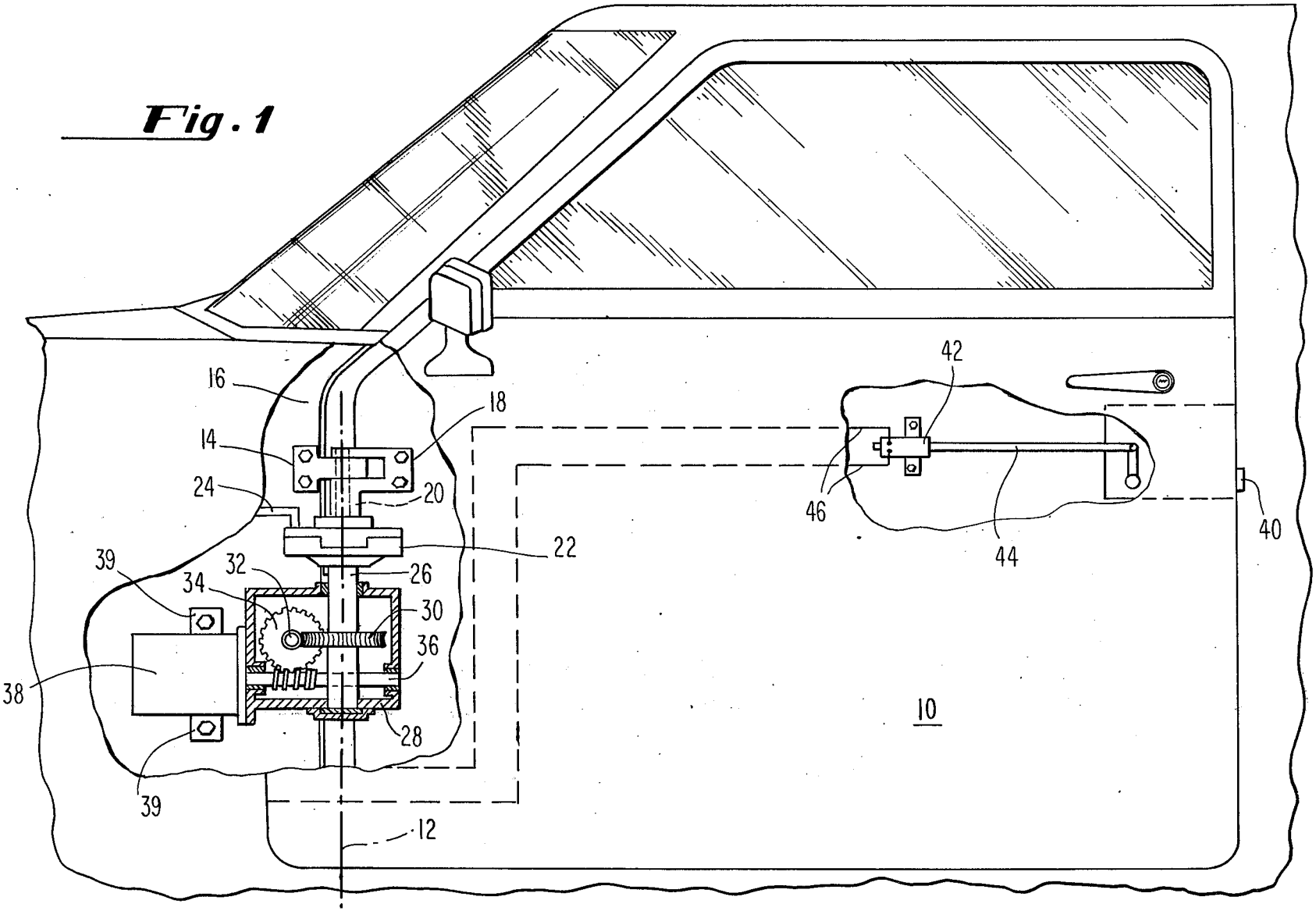
FIG. 1 is a partially sectioned diagram illustrating one embodiment of the invention.

FIG. 1 represents a view of one door of a conventional automobile, equipped with a drive system embodying the present invention. Door 10 is supported by hinges in a conventional manner. The hinges are arranged to define a pivotal axis 12 which extends generally vertically with respect to the vehicle. An upper hinge is shown and includes a stationary portion 14 which is affixed by bolts to a doorpost 16 or similar fixed structural member of the vehicle. The hinge also comprises a movable section 18 which is secured to door 10 by bolts or the like. The movable section of the hinge, which may include the hinge pin, has a downwardly-depending portion 20 which is coupled by means of a key, bolts, or the like to an electromagnetic clutch 22. Clutch 22 is of the normally-disengaged type, having springs or the like to maintain the clutch halves in spaced relationship. In a preferred embodiment a standard commercially-available machine drive clutch having a 4 inch diameter engagement disc is utilized. As is conventional in such units the clutch includes electromagnetic windings which may be energized by means of wires 24 to cause the clutch to engage.

Clutch 22 is in turn driven by an output shaft 26 extending upwardly from gear box 28. An output drive gear 30 which is secured to the output shaft is driven by a worm gear 32. The worm gear is in turn turned by another reduction gear 34 which is turned by means of an input worm drive 36. An electric motor 38, which may be a standard 3600 RPM 12-volt auto accessory motor, is coupled to worm shaft 36 and supplies torque to the gear reduction system. The motor 38 is secured to doorpost 16 by means of appropriate brackets and bolts 39.

Although door 10 may be manually unlatched preparatory to operation of the drive mechanism, in a preferred embodiment the door latch 40 is operated by means of an electric solenoid 42 coupled to the latch by means of an elongate link 44. Wires 46 supply current to the solenoid from a remote switch (not shown) to cause the plunger of the solenoid to retract. As the solenoid plunger moves to the left, it pulls link 44 and in this manner operates the door latch. Although various types of solenoids are available, a 12-volt unit of the type ordinarily used to engage automobile and truck starter motor drive gears has been found to be both economical and serviceable.

Figure 2:
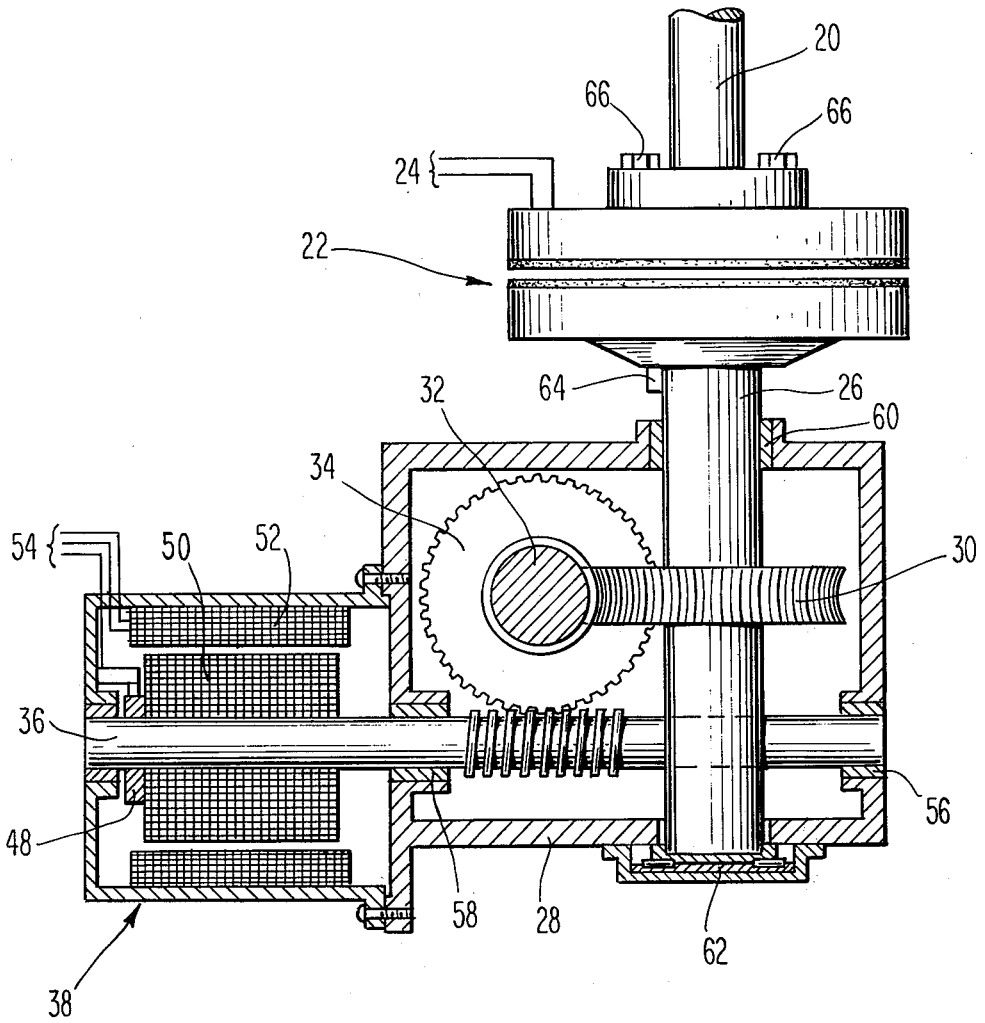
FIG. 2 illustrates structural details of the drive system utilized.

Turning now to FIG. 2 there is illustrated in further detail the drive system of FIG. 1. The housing 28 of the gear box unit, which is small and compact in nature and can easily be fitted adjacent to the doorpost of a conventional automobile, is secured to the frame of motor 38 by bolts or the like. The motor drive shaft 36 is provided with a worm gear section for engaging gear 34. The motor, which is a 12-volt DC accessory motor, includes a commutator 48, rotor 50 and field winding 52 in the usual manner. Leads 54 are brought out from the brush rigging and field windings of the motor, and advantageously are connected to windings for effecting both the forward and reverse rotor rotation.

At the distal end of shaft 36 is a thrust bearing 56 for absorbing the thrust generated in turning gear 34. The latter gear is coupled, by means of a key or the like, to a worm gear shaft 32 to form an irreversible drive. By irreversible is meant that torque exerted on the output shaft of a drive train will not cause the input shaft thereof to rotate, e.g. a driven gear cannot be rotated to turn a worm gear which drives it. The second worm gear shaft engages an output drive gear 30 which is affixed to output shaft 26 so that an overall reduction gear ratio of approximately 900:1 is achieved. In a presently preferred embodiment each worm-and-gear set provided a reduction factor of 30:1, giving the overall gear reduction factor quoted above.

Bushings 58 and 60 serve to support shafts 36, 26 respectively, while another thrust bearing 62 receives the lowermost end of output shaft 26. The output shaft is coupled to clutch unit 22 by means of a key 64, while the upper half of the clutch unit is secured to hinge extension 20 by means of bolts 66. Wires 24 lead from the upper section of the clutch to a switched source of electric power, so that the clutch may be engaged only when the drive system is to be operated.

The latter aspect of the invention is of extreme importance to the "fail-safe" aspect of the system, and to the safety of the vehicle's occupants. Prior art door operation systems have included various types of electric, mechanical and hydraulic mechanisms which were permanently engaged. In some types of systems, i.e. hydraulic or direct-driven electrical systems, this does not present a substantial problem since the drive system is reversible, i.e. it presents no impediment to manual operation of the door should the system break down. However, such systems typically did not generate sufficient torque to be feasible; or alternatively, required such large and powerful drive systems as to be bulky and uneconomical. The present inventors have discovered, however, that by using a compact high-reduction gear system of the type shown a small and economical motor may be implemented. They have further found that, by coupling such a drive system to the hinge pin of a door member through a normally-disengaged clutch the door may be freely operated manually whenever the automatic system is not energized. In fact, the presence of the instant system is undetectable insofar as manual operation of the door is concerned since it is completely decoupled from the door mechanism when not in operation. Accordingly, it does not impede manual manipulation of the door and cannot trap the occupants of the vehicle in the event that any portion of the system should fail.

Figure 3:
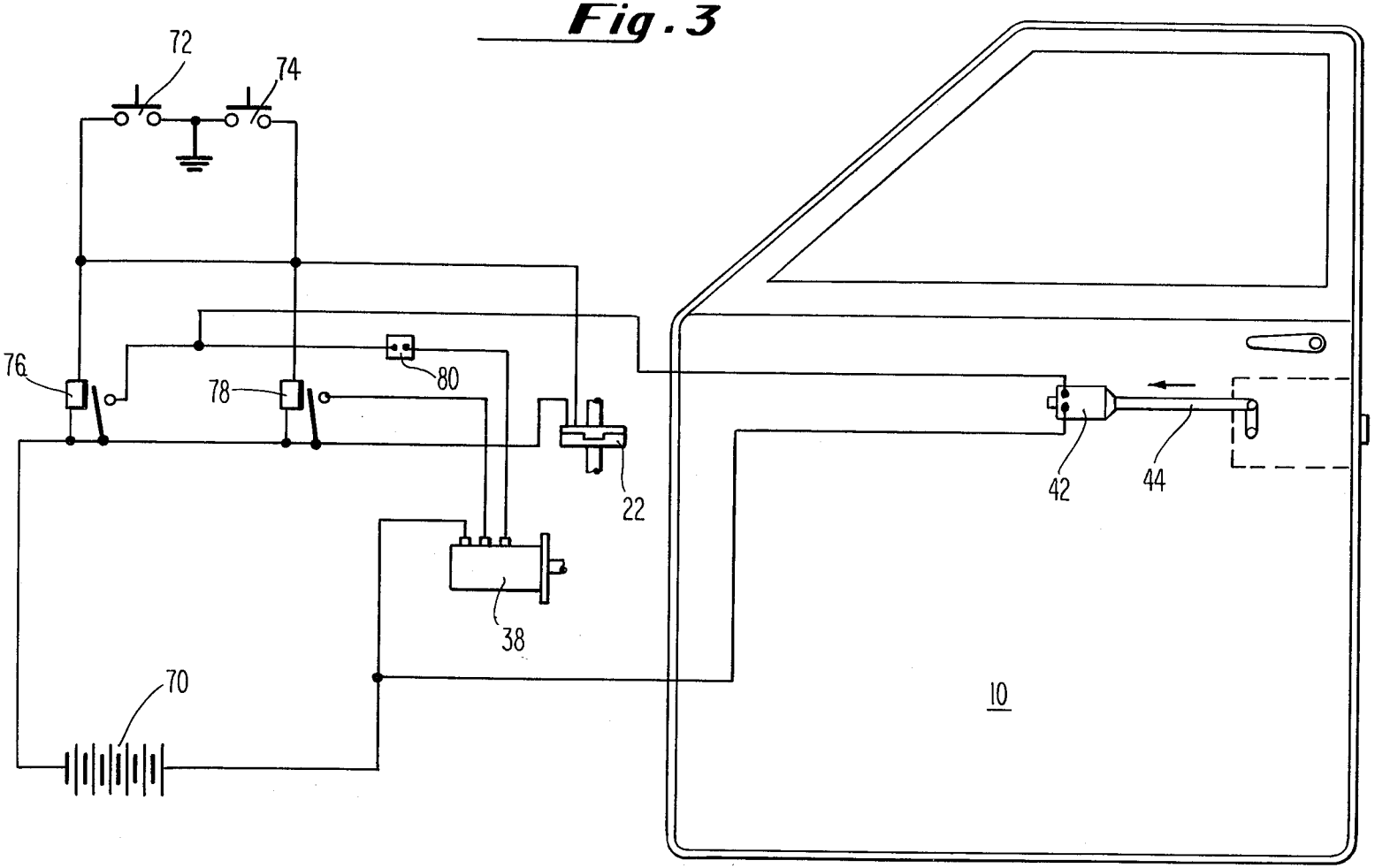
FIG. 3 is a schematic diagram of the control system of a preferred embodiment.

FIG. 3 schematically illustrates a control system used in the preferred embodiment of the invention. A battery 70 is coupled to one side of drive motor 38 and solenoid 42, as shown. A pair of switches 72, 74 are provided at an advantageous point within the automobile, such as the dashboard thereof. While any appropriate switches may be selected for use, in a preferred embodiment the switches take the form of spring-loaded pushbuttons. Switch 72 is coupled to a relay 76 and also to the control winding of clutch 22. In like manner button 74 is connected to the control winding of another relay 78 and to clutch unit 22. A commercially-available time delay 80, which may for instance be a simple R-C circuit of the type obtainable from electrical parts houses, is interposed between the output terminal of relay 76 and the "forward" terminal of motor 38. Finally, the remaining terminal of solenoid 42 is coupled to the output terminal of relay 76.

In operation, it will first be assumed that it is desired to automatically drive door 10 from an open to a closed position. In this event switch 74 is closed manually, as by pushing a conveniently-located button. Closing of the switch serves to ground the control winding of relay 78 and accordingly a circuit through the "reverse" winding of motor 38 is completed. At the same time switch 74 serves to complete a circuit to the control winding of electromagnetic clutch 22, so that as motor 38 begins to turn by way of gear box 28 (not shown in FIG. 3) the output torque will be transmitted through clutch 22 to the hinge pin of door 10. The door will then be rotated to a closed position at an appropriate speed, and upon closing will latch in the conventional manner.

If switch 74 is released before the door is fully shut, the electromagnetic clutch will release, allowing the door to seek its own position. If the door has not closed to the point where the usual detent has been overcome, the door will be held in an open position. Otherwise, the door will be free to move and can be manually opened or shut.

Consider now that door 10 is closed and latched and it is desired to open the door automatically. The button constituting switch 72 is manually depressed, energizing the control winding of relay 76. Accordingly, current is immediately supplied to solenoid 42 causing the solenoid to withdraw its plunger to the left, as indicated by the arrow, and urging link 44 in the same direction to cause the latch mechanism to release. Upon closure of switch 72 a circuit is completed through the control winding of electromagnetic clutch 22. This allows the clutch to engage, although motor 38 may yet be inoperative. After some predetermined time, which may be only a fraction of a second, elapses time delay stage 80 allows current to flow through the "forward" winding of motor 38.

With the door latch disengaged and clutch 22 engaged, motor 38 drives the gear reduction unit (not shown) and urges door 10 open by means of the presently-engaged electromagnetic clutch 22. After the door passes the usual detented position and is substantially open, the user releases switch 72 which de-energizes solenoid 42, clutch 22 and motor 38. Door 10 is then free to assume its normal open position and will remain there, held by the usual detent mechanism.

In the event that battery 70 fails, motor 38 burns out, or some other malfunction occurs in the control system it will be appreciated that door 10 can still be manipulated in the usual fashion. This is attributable to the fact that clutch 22 is normally disengaged, and requires the application of electrical energy to its windings before it can become engaged. Thus, the illustrated system is fail-safe since in all modes of failure the door can be opened or closed by hand.

It will be apparent that the invention just described constitutes a greatly improved door operating system for use in an automotive vehicle and exhibits none of the disadvantages of prior art systems.

Further, and as will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. In a motor vehicle having a body portion including a doorpost and further including at least one door having a latch, motive apparatus disposed adjacent said doorpost for urging the door from a closed to an open position, comprising:

an electric motor;

a compound gear reduction unit drivingly coupled to said motor for multiplying the torque output of said motor;

a hinge pivotally coupling the door of the vehicle to the doorpost thereof, said hinge defining a pivotal axis about which said door may swing;

said hinge comprising a stationary portion and a movable section, said stationary portion being secured to said doorpost and said movable section being secured to said door, said movable section comprising a downwardly-depending portion thereof disposed colinearly with said pivotal axis;

an electromagnetic clutch for selectively coupling said reduction gear unit to said movable section of said hinge for applying torque to said section in a direction for urging the door to an open position;

said electric motor, compound reduction gear unit and clutch all being disposed adjacent one side of said doorpost, said gear unit and clutch being coupled directly to said movable section and being axially aligned with the pivotal axis of said hinge for transmitting torque directly to said movable section;

a source of electric current; and switch means for selectively applying current to said motor and to said clutch.

2. Apparatus according to claim 1, further comprising a solenoid disposed within the door and operatively coupled to the latch; wherein said switch means is operative to apply current to said solenoid.

3. Apparatus according to claim 2, further including time delay means coupled between said switch means and said motor to allow energization of said motor only after said solenoid is operated.

4. Apparatus according to claim 3, wherein said reduction gear unit comprises irreversible gearing.

5. Apparatus according to claim 4, wherein said electromagnetic clutch is normally released, and is engaged by the application of current thereto.

6. In a motor vehicle having a body portion including at least one door having a latch, motive apparatus for causing the door to pivot from a first position to a second position, comprising:

an electric motor;

a two-state worm gear unit drivingly coupled to said motor for multiplying the torque output thereof;

a hinge pivotally coupling the door of the motor vehicle to the body thereof and including a hinge pin having a downwardly-depending portion;

an electromagnetic clutch directly and fixedly coupled to said hinge pin for selectively coupling the downwardly-depending portion thereof to said reduction gear unit for applying torque directly to said hinge pin for causing said door to rotate on its axis;

a source of electric current; and switch means disposed within said vehicle for selectively applying current to said motor and to said electromagnetic clutch.

7. Apparatus according to claim 6, further including a solenoid disposed within the door and operatively connected to the latch; and circuit means coupling said solenoid to said switch means, whereby said latch is disengaged in response to operation of said switch means.

8. Apparatus according to claim 7, wherein said electromagnetic clutch is a normally released clutch, and is engaged in response to the application of current thereto.

* * * * *